US008387192B1

(12) United States Patent
Cooley et al.

(10) Patent No.: US 8,387,192 B1
(45) Date of Patent: Mar. 5, 2013

(54) ENHANCED ADJUSTABLE GANGWAY

(75) Inventors: James Ken Cooley, Pelzer, SC (US); Kellie P. Cooley, Pelzer, SC (US)

(73) Assignee: Docksliders, LLC, Pelzer, SC (US)

( * ) Notice: Subject to any disclaimer, the term of this patent is extended or adjusted under 35 U.S.C. 154(b) by 506 days.

(21) Appl. No.: 12/557,680

(22) Filed: Sep. 11, 2009

Related U.S. Application Data

(60) Provisional application No. 61/096,409, filed on Sep. 12, 2008.

(51) Int. Cl.
*E01D 1/00* (2006.01)
*B63C 1/00* (2006.01)

(52) U.S. Cl. ..... 14/71.3; 405/219

(58) Field of Classification Search ..... 14/71.5, 14/71.7, 75, 77.3, 70, 71.2, 72.5; 114/45–48, 114/230.27; 405/219
See application file for complete search history.

(56) References Cited

U.S. PATENT DOCUMENTS

| | | | | |
|---|---|---|---|---|
| 3,050,947 | A * | 8/1962 | Burton | 405/219 |
| 3,088,287 | A * | 5/1963 | Berry | 405/219 |
| 3,467,983 | A * | 9/1969 | Lipking | 16/288 |
| 3,668,729 | A * | 6/1972 | Mori et al. | 14/43 |
| 3,715,769 | A * | 2/1973 | Mori et al. | 14/71.1 |
| 4,035,861 | A | 7/1977 | Edge | |
| 4,133,067 | A | 1/1979 | Bennett et al. | |
| 4,300,854 | A * | 11/1981 | Sluys | 405/1 |
| 4,549,835 | A * | 10/1985 | Ando et al. | 405/4 |
| 4,845,792 | A | 7/1989 | Bakula et al. | |
| 4,998,313 | A | 3/1991 | Lippka et al. | |
| 5,247,899 | A | 9/1993 | Boesser | |
| 5,657,832 | A | 8/1997 | Stevens | |
| 5,794,292 | A * | 8/1998 | Ricci, Jr. | 14/69.5 |
| 6,109,854 | A * | 8/2000 | Thompson et al. | 414/398 |
| 6,295,944 | B1 * | 10/2001 | Lovett | 114/263 |
| 6,813,792 | B2 | 11/2004 | Miller | |
| 6,854,147 | B1 * | 2/2005 | Ahlsten | 14/69.5 |
| 6,868,799 | B2 | 3/2005 | Wright | |
| 7,103,935 | B2 * | 9/2006 | Hill | 14/71.3 |
| 7,144,199 | B2 | 12/2006 | Bontje | |
| 7,241,078 | B2 * | 7/2007 | Surges | 405/220 |
| 7,731,472 | B2 * | 6/2010 | Miller et al. | 414/537 |
| 2004/0159273 | A1 | 8/2004 | Rogerson | |
| 2008/0298900 | A1 | 12/2008 | Keating | |
| 2009/0320736 | A1 | 12/2009 | Gerst et al. | |
| 2010/0012011 | A1 | 1/2010 | Gerst et al. | |

OTHER PUBLICATIONS

Nautic Expo, The Virtual Boat and Marine Show, Category Pontoon gangways, Dock gates, retrieved Dec. 20, 2010, 11 pages.
RBC Bearings, Featured Product, The RBC Roller Cam Follower, Copyright 2006, 2007, 2008 RBC Bearings Incorporated, 3 pages.
CM Waterfront Solutions; Corrosion Resistance of Aluminum, A CMI Technical White Paper written by Jon Perryman, Jan. 2007, Copyright 2007 Crane Materials International, 5 pages.
Collins Dock Inc., Docks; Retrieved from http://www.collinsdock.com/Docks/docks_main_01.htm, [retrieved on Sep. 8, 2009].
Lainier Boat Services, Boat Dock Moving; copyright 2006 ; Retrieved from http://www.lanierboatservices.com/dock-moving.htm, [retrieved on Aug. 14, 2008].

(Continued)

*Primary Examiner* — Thomas B Will
*Assistant Examiner* — Abigail A Risic
(74) *Attorney, Agent, or Firm* — Banner & Witcoff, Ltd.

(57) ABSTRACT

A shore-to-dock/boat access system is disclosed for use on a body of water with changing water levels. The system may be composed of non-corrosive fiberglass (or fiberglass-like) materials and include numerous installation components: A gangway supporting structure may be affixed to the shore using support members. A moveable gangway structure may be slideably connected to the gangway supporting structure with the assistance of a slider assembly including, inter alia, cam followers, a pivot unit, and/or runner plate. In addition, methods are disclosed for installing and servicing the system.

13 Claims, 10 Drawing Sheets

OTHER PUBLICATIONS

Floatation Systems, Inc. Aluminum Gangways/Ramps; Copyright 2005; Retrieved from http://www.aluminumboatdocks.com/gameways.htm, [retrieved on Sep. 8, 2009].

Emerson Power Transmission; McGill Heavy-Duty Camrol Bearings, Cylindrical-Roller Cam Followers; Copyright 2001, 6 pages.

Wahoo Docks, Gangways Connection Systems; copyright 2007; Retrieved from http://www.wahoodocks.com/gangways/connection/; [retrieved on Aug. 14, 2008].

T & M Custom Boat Decks; Our Product; Retrieved from http://www.tandmcustomdocks.com/product/html; [retrieved on Sep. 8, 2009].

PI 486 Titanium Telescopic retracting two-stage gangway, 2 pages.

Jet Dock, Floating Docks and Floating Walkways; Copyright 1999; Retrieved from http://www.jetdock.com/floating-dock.asp, [retrieved on Aug. 14, 2008].

Gator Dock: Floating Docks, copyright 2007; Retrieved from http://www.cmiwaterfront.com;Docks/Floating-Docks.php; [retrieved on Aug. 14, 2008].

Majestic Jetties & Marinas, Gangways, copyright 2007; Retrieved from http://www.majesticjetties.com/ganway.html; [retrieved on Aug. 14, 2008].

Dock'Rite Boat Lifts, Ltd., Wheel Docks; Retrieved from http://www.dockrite.com/wheeldocks.htm; [retrieved on Aug. 14, 2008].

* cited by examiner

| PRODUCT LIST | | | | |
|---|---|---|---|---|
| TAG | COMPONENT | DESCRIPTION | QTY. | SHEET REF. |
| A | BASE PLATE | 1/4" THICK TYPE 304 STAINLESS STEEL | 1 | D-1 |
| B | PIVOT PLATE | 3/8" THICK TYPE 304 STAINLESS STEEL | 1 | D-2 |
| C | TIE/PIVOT ROD | 1"ø TYPE 304 STAINLESS STEEL TUBING; 5/16" WALL THICKNESS | 2 | D-3 |
| D | POST MOUNT PLATE | 3/8" THICK TYPE 304 STAINLESS STEEL | 4 | D-7 |
| E | SLED RUNNER PLATE | TYPE 304 STAINLESS STEEL | 2 | D-4 |
| F | SLED RUNNER MIDPLATE | 1/2" THICK TYPE 304 STAINLESS STEEL; WELDED TO SLED RUNNER PLATE | 2 | D-4 |
| G | CROSS SUPPORT CHANNEL | 5 1/2"x1 1/2"x1/4" FIBERGLASS CHANNEL | 5 | D-5 |
| H | CONNECTION ANGLE | 3"x3"x3/8" FIBERGLASS ANGLE | 10 | D-6 |
| J | I BEAM | 8"x4"x1/2" FIBERGLASS I BEAM | 2 | D-8 |
| K | CAM FOLLOWER | NO-LUBE TRACK ROLLER; HEX-SOCKETED HEAD; CARBON STEEL OUTER ROLLER WITH SINTERED BRONZE INNER SLEEVE; 3/4"ø ROLLER; 3/8"ø STUD' 3/8"-24 THREAD WITH MCMASTER-CARR NYLON 6/6 90494A231 NUT | 4 | AS-3 |
| L | SHOULDER SCREW | STAINLESS STEEL, PLAIN FINISH, SOCKET HEAD SHOULDER SCREW; 3/4"-10 THREAD; 1 5/16"ø HEAD; 1"ø SHOULDER AT 1" LONG; 1/2" HEX SIZE | 1 | AS-3 |
| M | SHAFT COLLAR | TWO-PIECE CLAMP-ON, STEEL SHAFT COLLAR; 1" BORE, 2-1/4" O.D., 5/16-24 SCREW SIZE | 2 | AS-3 |
| N | CAP SCREW | HEAVY HEX, STAINLESS STEEL, PLAIN FINISH CAP SCREW; CLASS 2A THREAD FIT; 1/2"-13 THREAD; PARTIALLY THREADED; 2" LONG WITH 7/8" HEAD WIDTH | 4 | AS-3 |
| P | SHOULDER SCREW WASHER | ROUND HOLE STAINLESS STEEL PLAIN FINISH WASHER; 1" I.D.; 2" O.D.; 0.134 MINIMUM THICKNESS | 2 | AS-3 |
| Q | NUTS | PLAIN FINISH, FIBERGLASS HEX NUT; 5/8"-11 WITH STANDARD THREADS | 80 | AS-3 |
| R | WASHERS | PLAIN FINISH, FIBERGLASS ROUND HOLE WASHER; 1.193" O.D.; 0.64" I.D. | 80 | AS-3 |
| T | DECKING CAP SCREW | 2" FLATHEAD NYLON 6/6 SLOTTED MACHINE SCREWS; 1/4-20 THREAD; 82° HEAD ANGLE WITH MCMASTER-CARR 94812A116 NUT | 46 | AS-3 |
| U | UHMW-PE CAP SCREW | 1 3/4" FLATHEAD 316 STAINLESS STEEL SOCKET CAP SCREW; 3/8"-16 FULLY THREADED; 82° HEAD ANGLE WITH MCMASTER-CARR 94812A116 NUT | 10 | AS-3 |
| V | 2 7/8" - 5/8"ø ROD | 5/8"-11 THREADED ROD FOR I-BEAM ATTACHMENT | 20 | AS-2 |
| W | 2 5/8" - 5/8"ø ROD | 5/8"-11 THREADED ROD FOR CHANNEL ATTACHMENT | 20 | AS-2 |
| X | CAM FOLLOWER | LONG LIFE CAM FOLLOWERS: 1"ø ROLLER; 0.4375"ø STUD; 7/16-20 THREAD; 1/4 HEAD WRENCH WITH MCMASTER-CARR 90494A232 NUT | 4 | AS-3 |
| Y | SPACER | STEEL NICKEL-CHROME PLATED STEEL STANDARD FEMALE UNTHREADED ROUND SPACER; 1/4" LONG; 0.406 I.D. 3/4" O.D. | 4 | AS-3 |
| Z | 1" THICK UHMW-PE | 1" THICK ULTRA HIGH MOLECULAR WEIGHT POLYETHYLENE (UHMW-PE) | 2 | D-9 |
| AA | 1/4" THICK UHMW-PE | 1/4" THICK ULTRA HIGH MOLECULAR WEIGHT POLYETHYLENE (UHMW-PE) | 2 | D-10 |
| BB | UHMW-PE HEX NUT | NYLON 6/6 HEX NUT; 9/16" WIDE; HEIGHT 11/32" | 10 | AS-1 |
| CC | THREADED LOCK COLLAR | STAINLESS STEEL THREADED CLAMP-ON LOCK COLLAR; 3/4"-10 BORE; 1/2" WIDTH; WITH 1/4"-28 SET/CAP SCREW | 1 | AS-3 |
| - | ADHESIVE | LOCTITE H4800 SPEEDBONDER STRUCTURAL ADHESIVE PER FIBERGLASS | - | |

FIG. 6D

ENHANCED ADJUSTABLE GANGWAY

This application claims priority from U.S. Provisional Patent Application Ser. No. 61/096,409, filed Sep. 12, 2008, which is herein incorporated by reference in its entirety.

TECHNICAL FIELD

Aspects of the disclosure generally relate to systems and methods for enhancing access over aquatic areas in variable conditions.

BACKGROUND

In the boating industry, there have been numerous innovations on the basic concept of docks and gangways bridging the gap between land/shoreline and a boat. For example, gangways with non-slip stone effect fiberglass decking are known in the art. In addition, galvanized steel gangways with hardwood decking are known in the art. Regarding docking technology, floating docks are well known in the art.

To accommodate a variable shoreline, some companies provide gangways with fixed-axle wheels or adjustable wheels. Although these systems allow the gangway to be adjusted to accommodate a variable shoreline, they are cumbersome in practice because the wheels that enable movement are commonly lodged in mud or difficult to use. Moreover, at least one company states that fixed axle wheels are not appropriate if the gangway is a component for the anchoring for a dock, such as with cable-to-shore anchoring.

Some companies even provide dock ramp moving services. In some states, docks and walkways must be at least thirty-six inches above high tide level. On Lake Lanier, for example, water levels continue to raise and fall, thus requiring boat owners to move their docks to accommodate the water level changes. Services are offered at the lake to provide one-time ramp move calls or yearly contracts. These services can be costly and/or recurring.

BRIEF SUMMARY

Aspects of the present disclosure address one or more of the issues mentioned above by disclosing systems, devices, and methods for enabling access between a shore and dock. The following presents a simplified summary of the disclosure in order to provide a basic understanding of some aspects. It is not intended to delineate the scope of the invention. The following summary merely presents some concepts of the disclosure in a simplified form as a prelude to the more detailed description provided below.

In one example, a shore-to-dock access system for use on a variable water level body of water is disclosed. The system may include an affixable gangway supporting structure with at least one longitudinal groove for enabling slideable movement. The supporting structure may be installed at an angle less than 30 degrees relative to the water level using support members that are posted into the ground. The gangway supporting structure may be comprised of decking materials, e.g., polyvinyl reinforced fiberglass decking material, laid side-by-side along the structure. The supporting structure may include a sled runner plate with cam followers configured to engage the at least one longitudinal groove to enable slideable movement. The system may also include a moveable gangway structure with an affixed slider assembly. The slider assembly may include a pivot plate and other features, e.g., a motor and/or guy wire system.

BRIEF DESCRIPTION OF THE DRAWINGS

The present disclosure is illustrated by way of example and not limited in the accompanying figures in which like reference numerals indicate similar elements and in which:

FIG. 6D is a chart describing various components illustrated in FIGS. 1-4, 5A, 5B, 6A, 6B, and 6C.

DETAILED DESCRIPTION

In accordance with various aspects of the disclosure, an enhanced adjustable gangway system and methods for its assembly and use are disclosed. The system may be used in environments where water levels may vary over time due to, inter alia, tidal movements, drought, and varying lake conditions. The system permits access to aquatic devices (e.g., boat, waverunner, etc.) or a dock from a shore with a variable shoreline.

Figure 1:
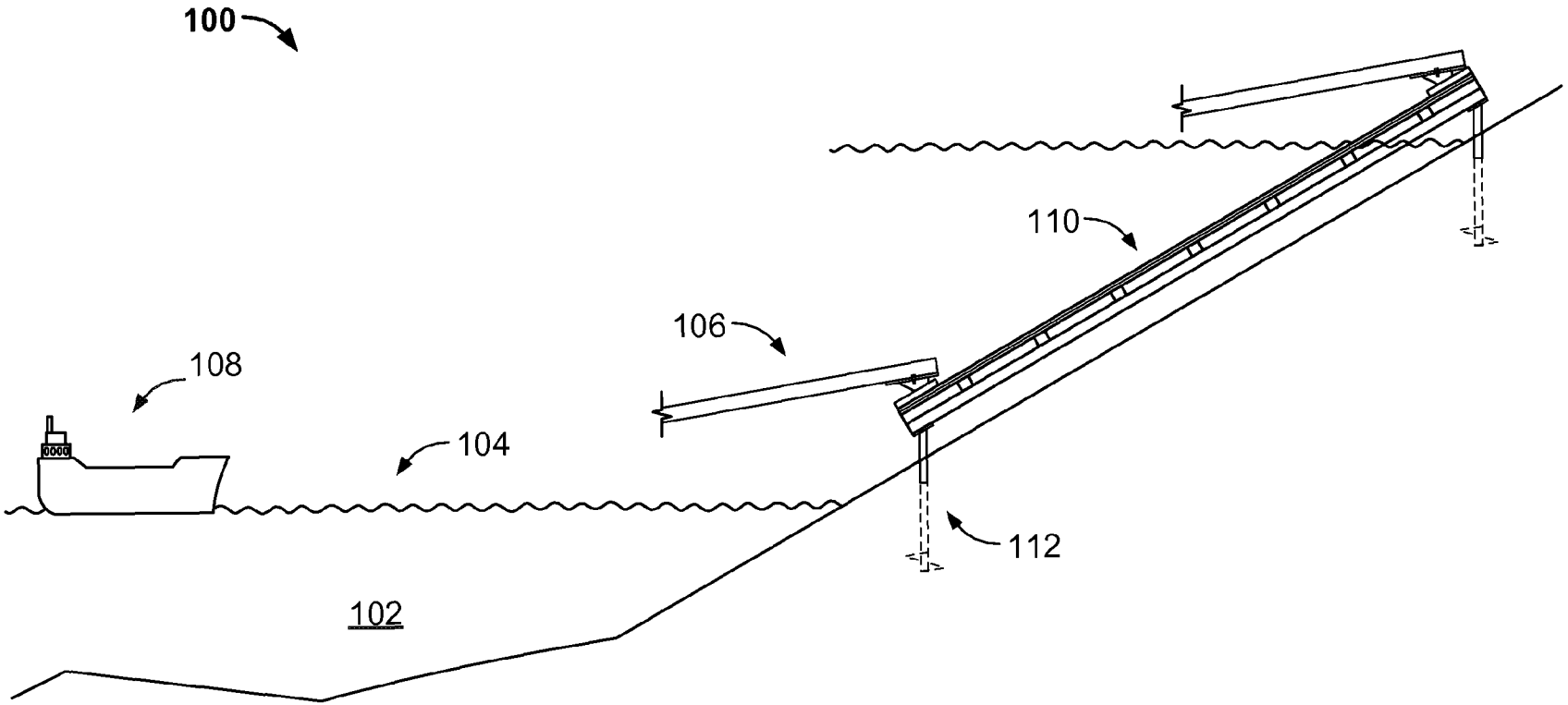
FIG. 1 shows an illustrative environment in accordance with various aspects of the disclosure.

FIG. 1 depicts an example of an illustrative environment 100 that may be used according to one or more illustrative embodiments of the invention. The system environment 100 is only one example of a suitable environment and is not intended to suggest any limitation as to the scope of use or functionality of the invention. The system environment 100 should not be interpreted as having any dependency or requirement relating to any one or combination of components illustrated in the exemplary system environment 100.

FIG. 1 depicts a body of water 102 with a variable water level 104. In some climate conditions, the water level 104 may increase and move vertically up and horizontally up the shoreline. In other climate conditions, the water level 104 may decrease and move vertically down and horizontally down the shoreline. A gangway 106 (or walkway) may be used to permit access to an aquatic device 108 (e.g., boat, waverunner, etc.) near a shoreline. An affixable gangway supporting structure 110 may be installed near the shore. In one example, the supporting structure 110 may be affixed to the shore using support members 112 that are sufficiently implanted into the surface of the shore to fix the position of the supporting structure. FIG. 1 depicts an embodiment of the affixable gangway structure 110 from a side-view perspective once installed on a shore. The affixable gangway supporting structure 110 may span a predetermined length (e.g., approximately 15 feet, approximately 20 feet, or other length) and be comprised of numerous enhanced gangway platforms organized in a side-by-side manner along the longitudinal direction of the affixable gangway supporting structure 110. The longitudinal axis runs along the longer side of the gangway supporting structure 110, while the latitudinal axis runs perpendicular to the longitudinal axis.

Figure 4:
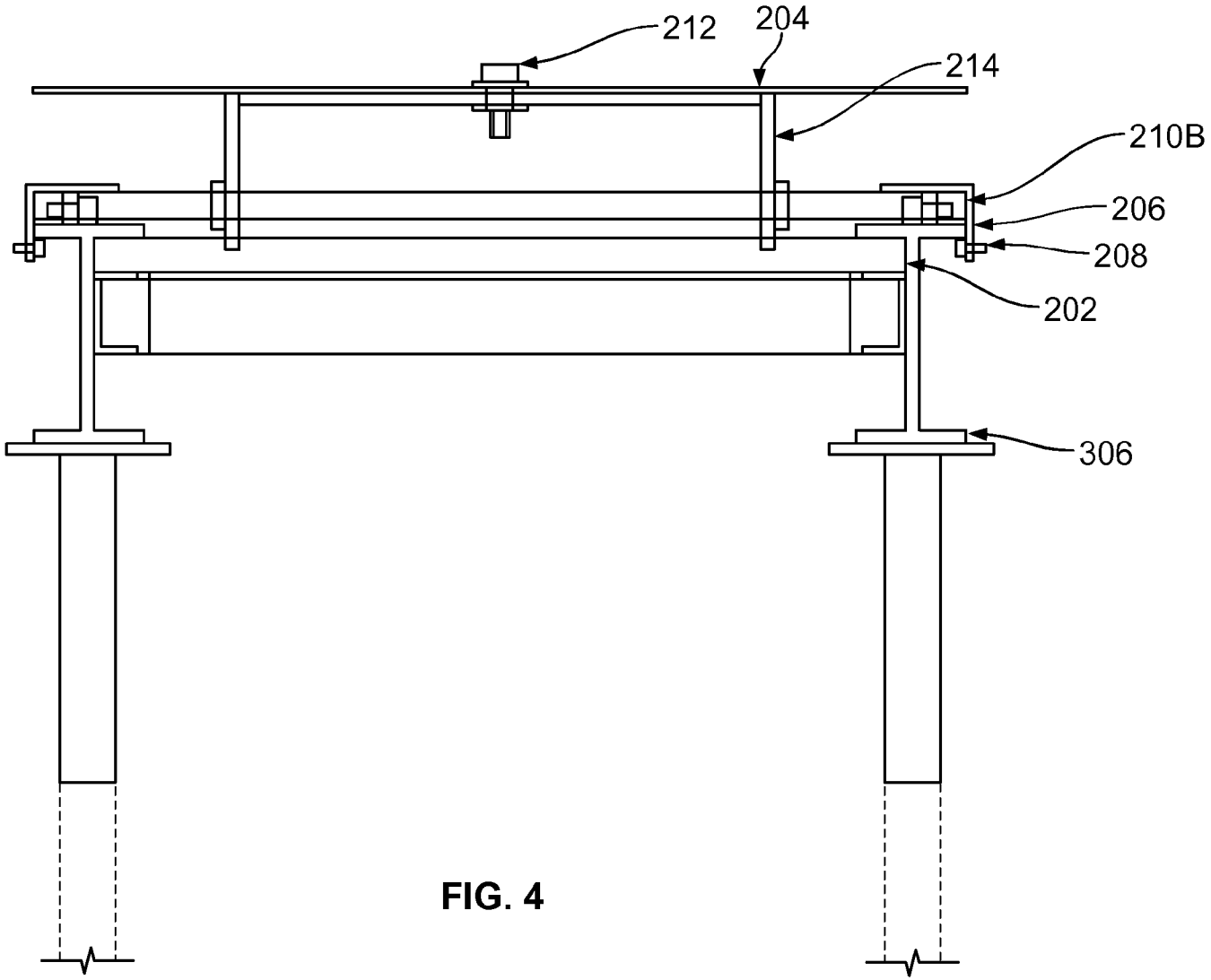
FIG. 4 illustrates a side view of the enhanced adjustable gangway structure depicted in FIG. 2 in accordance with various aspects of the disclosure.
Figure 5A:
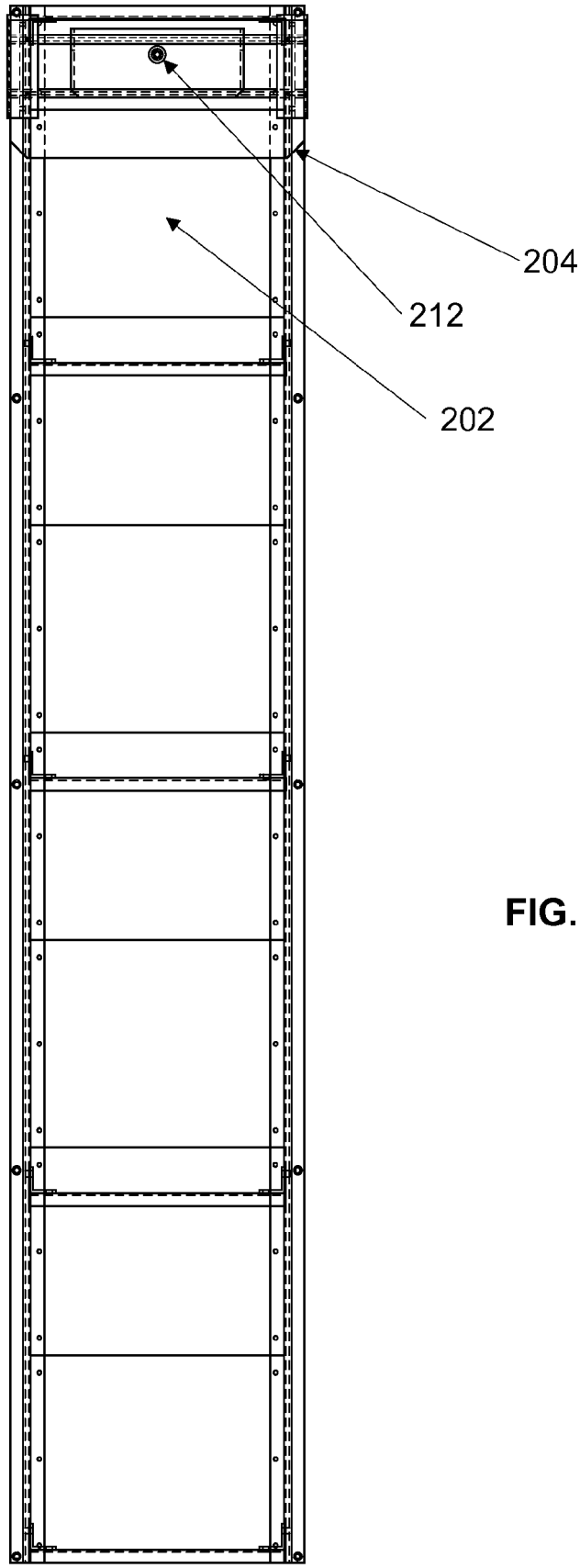
FIG. 5A illustrates a top view of a gangway supporting structure (e.g., as identified in FIG. 1) in accordance with various aspects of the disclosure.
Figure 5B:
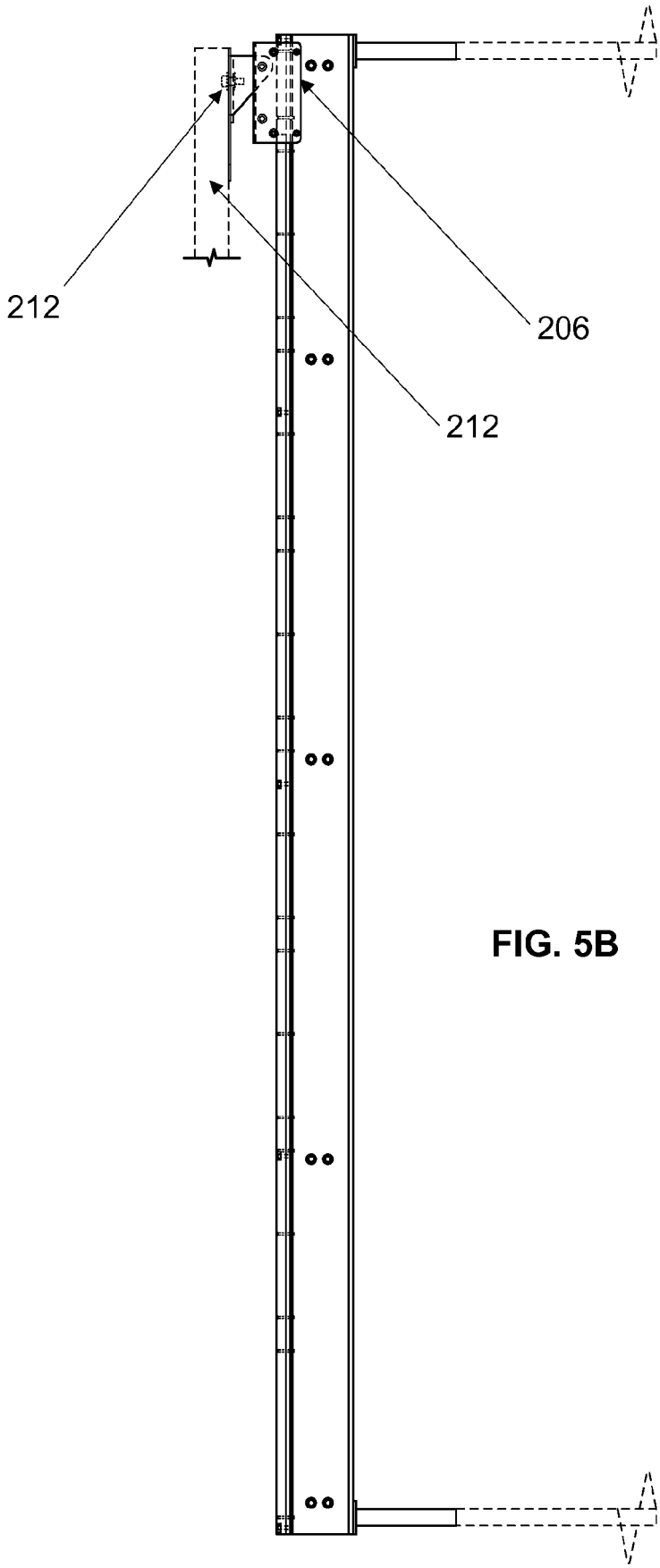
FIG. 5B illustrates a side view of a gangway supporting structure and slider assembly (e.g., as identified in FIGS. 1-4) in accordance with various aspects of the disclosure.

In one example, the plurality of gangway platforms may be decking material (see FIG. 11) laid in a side-by-side manner along the gangway supporting structure 110. The decking material may be placed between opposing I-beam structures (e.g., fiberglass I-beams) and above a cross support (e.g., a fiberglass cross support), as depicted in FIG. 4; FIG. 8 and FIG. 10 illustrate engineering schematics of one example of the aforementioned features. The gangway platforms may be conventional wood or wood-like planks. Alternatively, in accordance with various aspects of the disclosure, the gangway platforms may be a polyvinyl reinforced fiberglass material (or other comparable material) that withstands corrosion due to sustained immersion in water and other environmental effects.

In accordance with various aspects of the disclosure, the angle of installation of an affixable gangway supporting structure 110 is disclosed in FIG. 1. FIG. 1 illustrates one embodiment of the affixable gangway supporting structure 110 from a side-view perspective once installed on a shore. The supporting structure 110, in one example, may be installed at a thirty degree incline relative to the water level. In another example, the supporting structure 110 may be installed at a four degree incline relative to the water level. In yet another example, the supporting structure 110 may be installed at an angle less than thirty degrees, but sufficient to traverse the shore and accommodate changes in the water level (i.e., not a flat zero degree installation). Installation at angles greater than thirty degrees is also possible; however, the affixed gangway supporting structure 110 may be modified in accordance with various aspects of the disclosure to accommodate the steeper incline. Examples of such gangway supporting structures are discussed in greater detail below.

Figure 2:
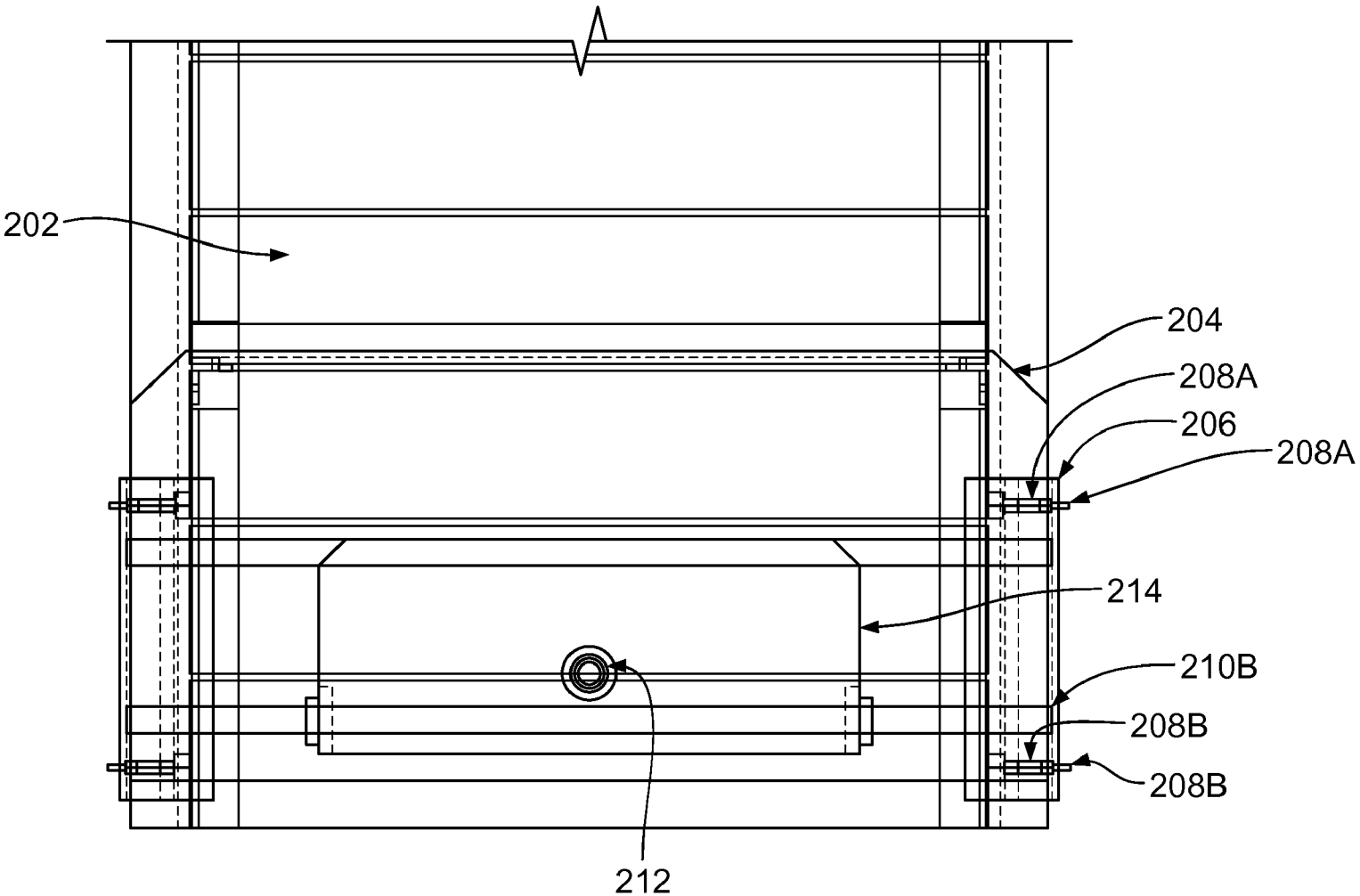
FIG. 2 illustrates a side view of one embodiment of the enhanced adjustable gangway structure in accordance with various aspects of the disclosure.
Figure 6A:
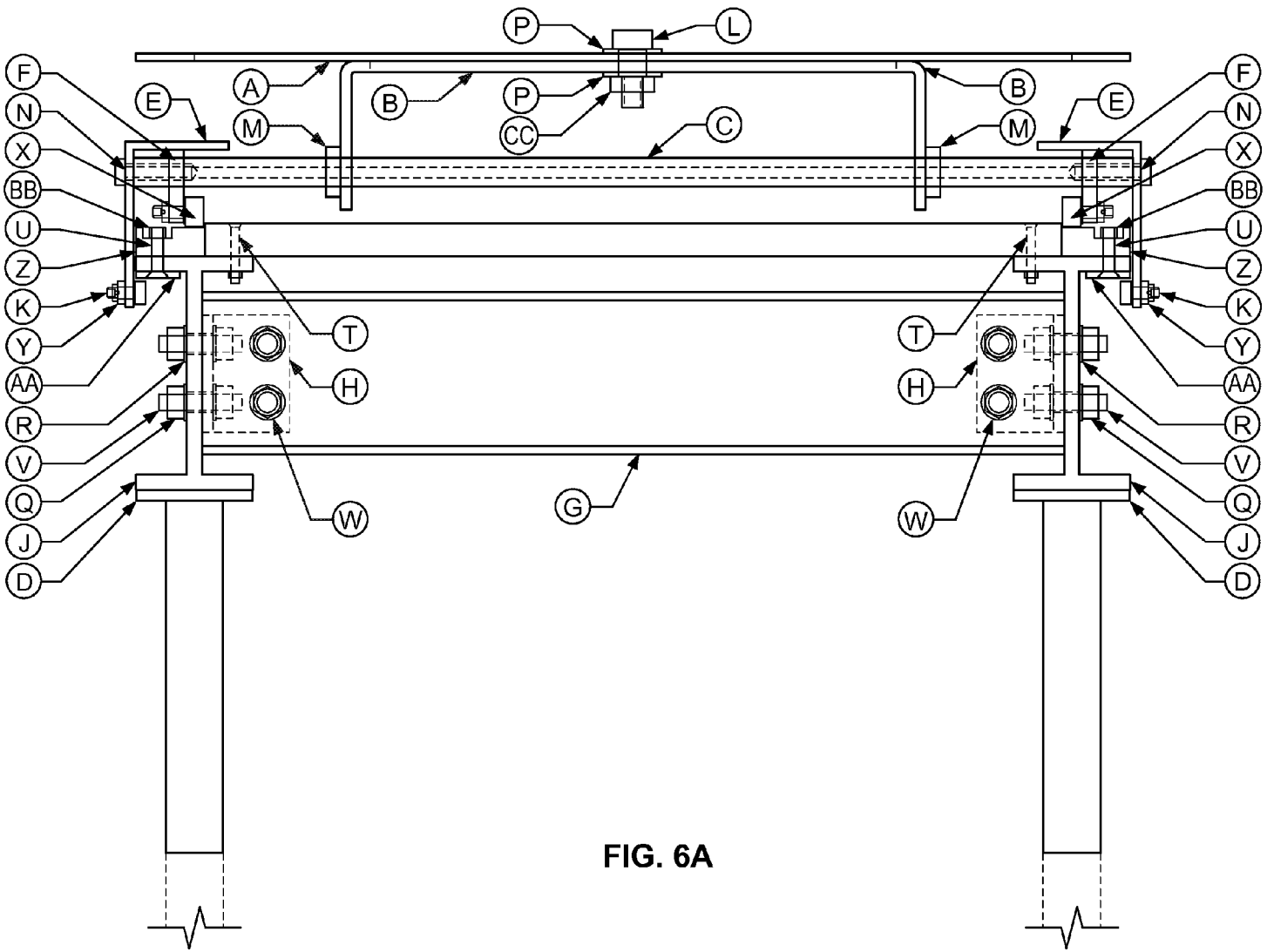
FIG. 6A illustrates a front view of an assembled slider assembly (e.g., as illustrated in FIGS. 2-4) in accordance with various aspects of the disclosure.
Figure 6B:
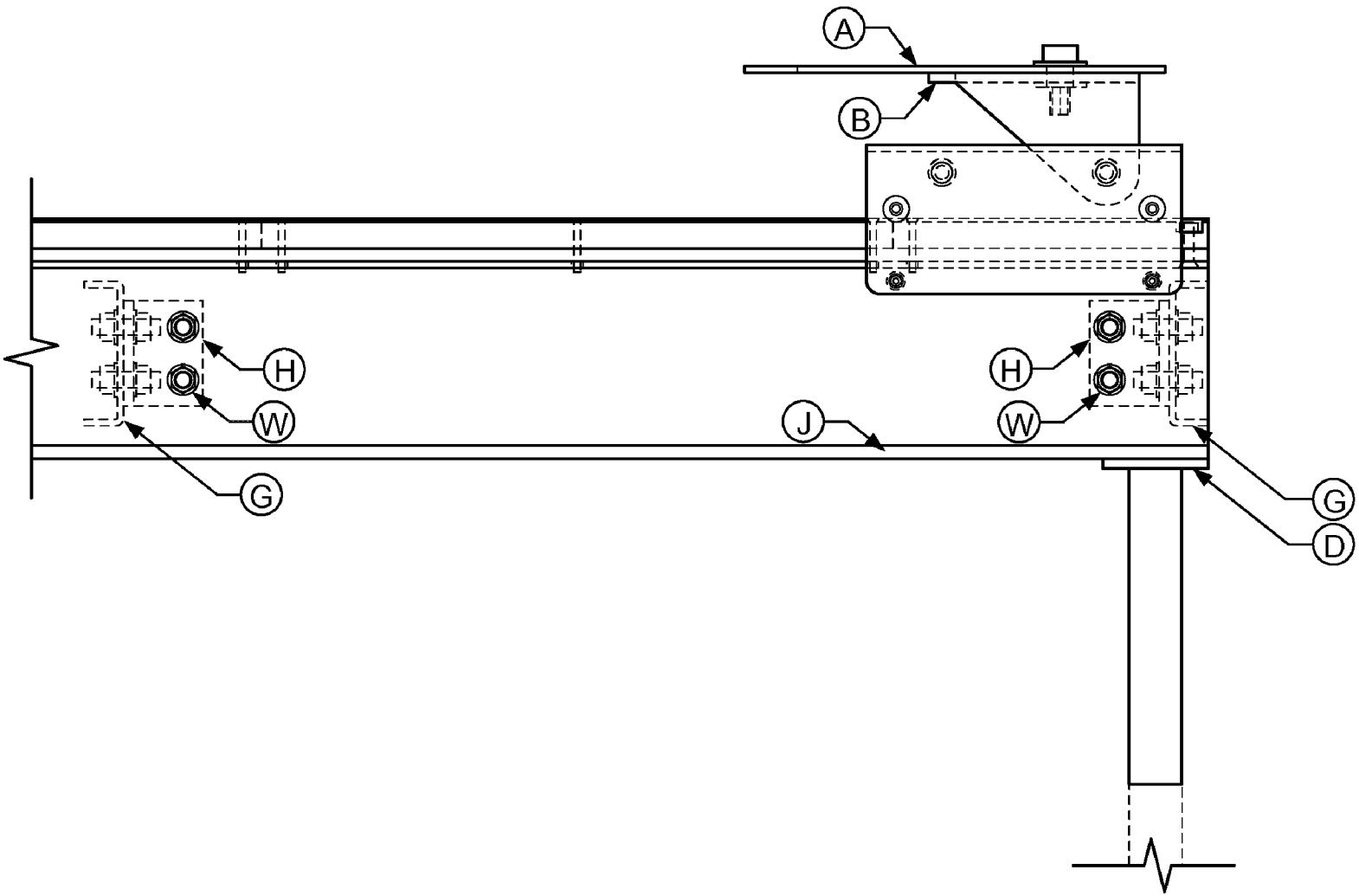
FIG. 6B illustrates a side view of an assembled slider assembly (e.g., as illustrated in FIGS. 2-4) in accordance with various aspects of the disclosure.
Figure 6C:
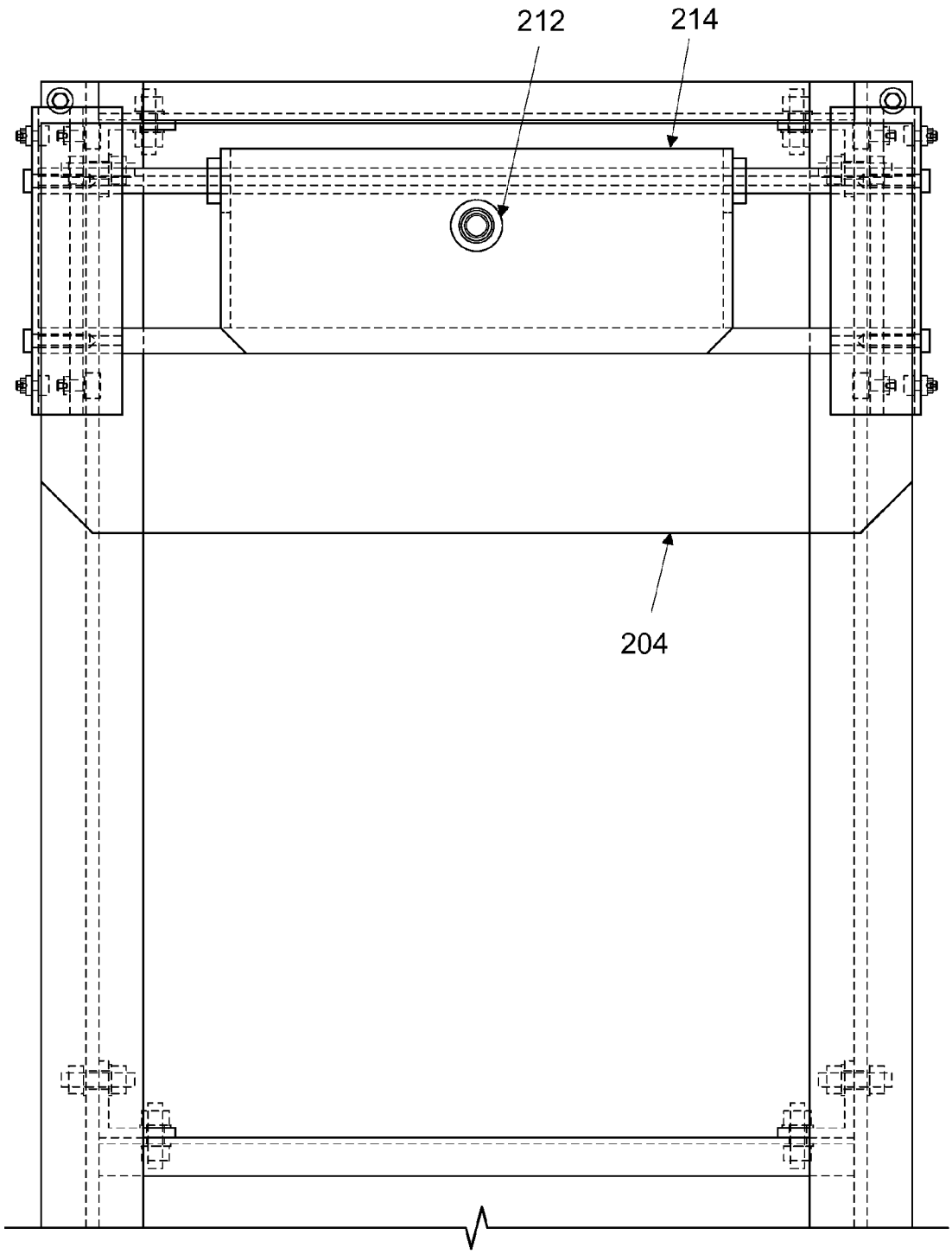
FIG. 6C illustrates a top view of an assembled slider assembly (e.g., as illustrated in FIGS. 2-4) in accordance with various aspects of the disclosure.

In accordance with various aspects of the disclosure, FIG. 2 illustrates an affixed gangway supporting structure. FIG. 2 illustrates one embodiment of the affixed gangway supporting structure 110 from a top-view perspective. The opposing sides of the affixed gangway supporting structure 110 may be used to form longitudinal grooves. For example, a sled runner plate (206) slideably affixed to the supporting structure 110 may include a plurality of cam followers (208A, 208B) to enable slideable contact along the structure 110 (e.g., cylindrical rollers in the cam followers may rotate as the sled runner plate moves along a long axis of the supporting structure). One example of the longitudinal groove's position along the I-beam (306) of the gangway supporting structure 110 is more clearly visible in the perspective of FIG. 6A. In that example, the longitudinal groove is defined by the cam followers above and below the edge of the I-beam. In other words, the groove, in accordance with various aspects of the disclosure, need not be a physical indentation in a material; rather, a groove may be defined by the one or more parts creating a channel to enable slideable movement. Moreover, in some embodiments in accordance with aspects of the disclosure, a wear plate (or comparable material or component) may be installed on the gangway supporting structure to reduce the wear on the structure caused by cam followers rolling (i.e., sliding/rotating) over the surface. For example, UHMW-PE material of varying thickness that may be used in implementing such wear plates.

Cam followers (e.g., a means for enabling slideable movement) assist in guiding the sled runner plate in a longitudinal direction along, for example, the I-beam. Furthermore, the placement and/or use of the cam followers, inter alia, assist in reducing undesirable torsional twisting of the enhanced adjustable gangway system. One skilled in the art will appreciate that means for enabling slideable movement, as recited in the claims, are defined to include not only conventional cam followers, but also to include other components that operate using, e.g., ball bearings to further the ease of slideable movement of the component.

Figure 3:
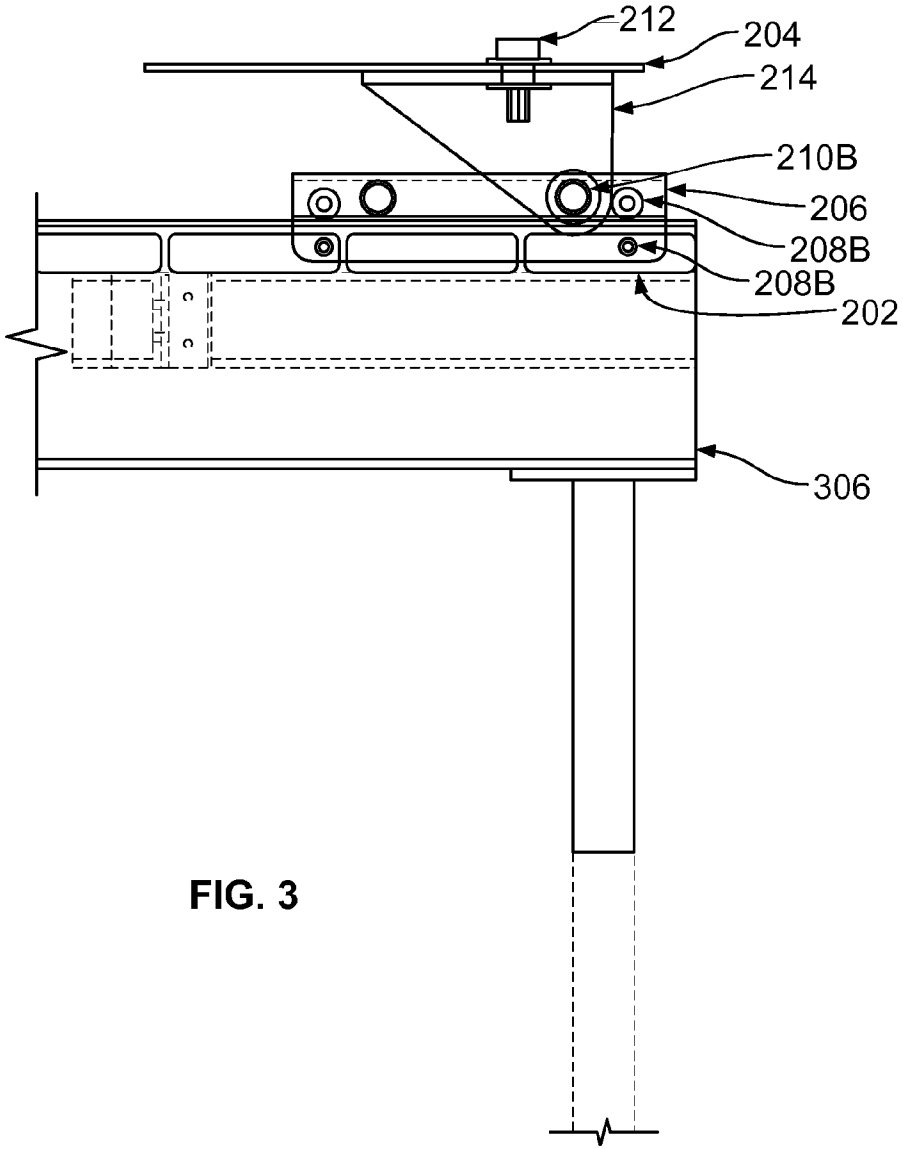
FIG. 3 illustrates a top view of the enhanced adjustable gangway structure depicted in FIG. 2 in accordance with various aspects of the disclosure.

In accordance with various aspects of the disclosure, a moveable gangway structure 106 is disclosed in FIG. 3. FIG. 3 illustrates one embodiment of the moveable gangway structure from a side-view perspective. The moveable gangway structure 106 is installed using a slider assembly that is affixed to it. In one example, the slider assembly may include a base plate (204) for affixing to the moveable gangway structure. The slider assembly may include, inter alia, various components to enhance the greater range of motion between the affixed gangway supporting structure 110 and the moveable gangway structure 106 it is installed upon. The slider assembly may also include, as depicted in FIG. 3, a pivot plate (214) and tie/pivot bar (210B) to allow a greater range of motion between the affixed gangway supporting structure 110 and the moveable gangway structure 106. Moreover, in various embodiments in accordance with the disclosure, the slider assembly may include a means for swiveling the system (e.g., a shoulder bolt 212 or comparable mechanism) to join the slider assembly with the moveable gangway structure. At least one function of the shoulder bolt is to allow a greater side-to-side range of motion between the moveable gangway structure 106 and an object (e.g., a dock or a boat) in the body of water. For example, the moveable gangway structure 106 may be positioned perpendicular to the gangway supporting structure because of the shoulder bolt. One skilled in the art will appreciate that mechanisms other a shoulder bolt may be used as a reasonable equivalent to perform the function of allowing greater side-to-side range of motion (i.e., swivel).

The slider assembly may also include cam followers configured to engage at least one longitudinal groove (e.g., along the edge of an I-beam, see FIG. 4). The cam followers allow for ease in moving the moveable gangway structure 106 along the supporting structure 110.

In accordance with various aspects of the disclosure, the system may include a stopping mechanism to keep the moveable gangway structure 106 from sliding off the supporting structure 100. In one example, the stopping mechanism may be a rubberized block to cushion the halting of any sliding motion (e.g., longitudinal motion caused by cylindrical rollers in the cam followers rotating along the long axis of the supporting structure) the moveable gangway structure 106 may be performing relative to the supporting structure 110. In another example, the cam followers may be used to keep mounting plate locked to the I-beam structures which are depicted in FIG. 4. One skilled in the art after review of the entirety disclosed herein will appreciate that a motorized assembly (i.e., comprising a motor and other components) may be used with the aforementioned features to further enable ease of movement/sliding. These and other aspects of the disclosure are described in greater detail below.

The slider assembly affixed to the moveable gangway structure 106 may include a locking mechanism to prevent the sled runner plates from sliding along the supporting structure 110. A user may engage the locking mechanism once the moveable gangway structure 106 is appropriately positioned for use. Numerous locking mechanisms for sliding components are well known in the art and can be implemented herein as necessary. For example, a spring loaded pin that locks in a pre-drilled hole may be used. In another example, a clamp on a lock may be used for a locking mechanism that may be easily operated.

In accordance with various aspects of the disclosure, the angle at which the moveable gangway structure 106 is safely operable may be dependent on the variation of tidal (and other factors) at the location. For example, a large tidal variation would require a longer gangway to maintain a slope of incline. For example, some published research in the field suggests that a 4.8 degree slope may be provided for safe boarding access under certain circumstances.

In accordance with various aspects of the disclosure, the distal end of the moveable gangway structure 106 that makes contact with a boat or dock may be equipped with wheels or rollers (or comparable mechanism) that enables the structure 106 to prevent scratches to the surface of the contacting area. Alternatively, the distal end may be laid upon the dock or edge of a boat. The proximal end of the moveable gangway structure 106 is the side opposite of the aforementioned distal end.

In accordance with various aspects of the disclosure, a conventional motor may be affixed to the moveable gangway structure 106 and/or the supporting structure 110. Alternatively, the motor may be externally located, but used in coordination with the shore-to-dock access system. The motor (not shown in FIG. 1) may use a guy wire (e.g., cable, wire, rope, etc.) to automate sliding of the moveable gangway structure along the supporting structure 110. For example, a mechanism (e.g., an electrical switch) may be provided to allow a user to activate the motor and slide the moveable gangway structure 106 as desired up/down the supporting structure 110. As such, a user no longer is required to exert physical force to manually readjust the gangway when water levels change. In another embodiment, the conventional motor may be in communication with a processor (e.g., contained in a computer) that allows a user to program the conventional motor to adjust positions at preset times/dates. For example, the user can program the system to elevate the gangway in the evening due to anticipated higher tides, and lower the gangway in the morning. In yet another embodiment, the system may include water detection sensors (or comparable electronic mechanisms) to trigger the motor to elevate/lower the gangway according to adjustments in the water level. One of skill in the art after review of the entirety disclosed herein will appreciate that the locking mechanism described above and/or other components of the system may also be automated in accordance with the aforementioned. For example, the locking mechanism may need to be automatically disengaged before the motor may elevate/lower the moveable gangway structure. However, one skilled in the art will appreciate that floating docks (or similar objects) may be attached to the shoreline using a guy wire system; and as such, the aforementioned motorized assembly may require coordination with this guy wire system to ensure that both systems are cooperating.

Although not required, one of ordinary skill in the art will appreciate that various aspects described herein may be embodied as a method, a data processing system, or as a computer-readable medium storing computer-executable instructions. For example, a computer-readable medium storing instructions to cause the processor in a computing device described above to perform steps of a method in accordance with aspects of the disclosure is contemplated. The computing device may be electronically coupled to a motor affixed to an enhanced adjusted gangway system such that the operation of the motor may be controlled by the processor of the computing device. In one example, the instructions executed by the processor may cause the motor to adjust (e.g., raise) a moveable gangway structure in accordance with changes to water level or other factors. In another example, the motor may be controlled through an initial signal generated by a remote device (e.g., a remote controller or a networked device electronically coupled in a wireless manner with the computing device.)

In an alternative embodiment of the disclosure, the moveable gangway structure 106 and/or the gangway supporting structure 110 may include handrails along one or more edges of the gangway. The handrail may enhance safety of the system for users travelling using the system.

In yet another alternative embodiment of the disclosure, slip-proof aspects may be included on the gangway system to enhance the safety of users travelling on the system. In one example, the slip-proof mechanism may be an abrasive pattern on the planks (202) of the gangway to increase friction between a user's foot/shoes and the surface. In situations where the gangway is wet/slippery, such mechanisms may be particularly useful. In another example, slip-proof aspects may be built into the gangway material itself.

In one embodiment in accordance with aspects of the disclosure, the gangway system may be assembled with enhanced planks along the length of the gangway that permit the planks to behave as steps (e.g., steps on a ladder). This feature may be useful at installations where the affixed supporting gangway structure 110 is at a large angle (e.g., greater than 30 degrees). From a practical and safety standpoint, the greater angles of the gangway structure 110 may leave it unsafe for traversing. Therefore, the gangway structure 110 may comprise steps in lieu of simple planks laid side-by-side. The steps may permit a user to more safely traverse the length of the gangway. In another embodiment, the steps may be adjustable at the time of installation of the supporting gangway structure 110. For example, the support members 112 may be installed and the angle of the supporting gangway structure 110 may be determined. Then the steps of the gangway structure 110 may be rotated and locked into place for use. The moveable gangway structure 106 may be slideably connected to installed gangway supporting structure 110.

For example, aspects of the disclosure contemplate elevation differences where the shoreline and the gangway system meet. Erosion, or other phenomenon, along the shoreline may leave a distance or gap. As such, an extension area (e.g., three or four steps) may be used to negotiate the distance or gap. In one example, the extension area may be an attachment point for the gangway system in accordance with various aspects of the disclosure.

Aspects of the invention have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure. Furthermore, the features of the embodiments described above contemplate other embodiments comprising one or more, or a combination thereof, of the aspects described throughout. Although the gangway system has been disclosed in an aquatic operating environment, one skilled in the art after review of the entirety disclosed herein will appreciate that the system may be implemented in a non-aquatic environment. For example, the disclosed enhanced gangway system may be implemented to assist in the boarding of an aircraft.

We claim:

1. A shore-to-gangway access system for use on a variable level body of water, the system comprising:

a gangway supporting structure with longitudinal edges configured to enable slideable movement, where the gangway supporting structure is affixed to the shore; and a slider assembly affixed near a proximal end of a moveable gangway structure, where the slider assembly is affixed to the moveable gangway structure using at least a means for swiveling, where the slider assembly includes a pivoting unit, runner plate, and cam followers configured to make slideable contact with the longitudinal edges of the gangway supporting structure and keep the runner plate mounted to the gangway supporting structure, where a distal end of the moveable gangway structure contacts a floating structure and the moveable gangway structure does not include a separate floatation device;

a motorized assembly to automate longitudinal movement of the moveable gangway structure relative to the gangway supporting structure; and a water detection sensor located near a proximal end of the moveable gangway structure, where the water detection sensor is configured to activate a motor in the motorized assembly in response to the sensor detecting water.

2. The system of claim 1, where the cam followers are affixed using the runner plate slideable along a longitude of the gangway supporting structure, where the longitudinal edges are at opposing sides of the gangway supporting structure, and where the gangway supporting structure and moveable gangway structure include fiberglass material.

3. The system of claim 2, where the slider assembly further includes a locking mechanism configured to prevent the runner plate from sliding along the gangway supporting structure.

4. The system of claim 1, where the gangway supporting structure comprises a removable stopping mechanism configured to prevent the moveable gangway structure from sliding off a short end of the gangway supporting structure.

5. The system of claim 1, where the motorized assembly includes a mechanism to allow a user to activate a motor in the motor assembly to retract a guy wire connected to the gangway supporting structure.

6. The system of claim 1, further comprising:

a remote device configured to activate the motorized assembly.

7. The system of claim 1, where the motorized assembly comprises a processor that causes a motor in the motorized assembly to automatically adjust the longitudinal position of the moveable gangway structure relative to the gangway supporting structure based on at least one of time of day and calendar date.

8. The system of claim 7, further comprising:

a remote networked device in communication over at least a wireless network with the processor of the motorized assembly configured to activate a motor in the motor assembly.

9. The system of claim 1, where the slider assembly further includes a locking mechanism configured to automatically disengage itself when a motor in the motorized assembly is activated.

10. The system of claim 1, where the gangway supporting structure is affixed to the shore by support members, and where the gangway supporting structure, once affixed to the shore by support members, forms an incline relative to a water level of the body of water.

11. A method for installing a shore access system, comprising:

affixing a gangway supporting structure into a variable shoreline, where the shoreline varies in accordance with water level changes, and the gangway supporting structure forms an incline relative to water level;

affixing a slider assembly near a proximal end of a movable gangway structure, where the slider assembly comprises a pivot plate, a runner plate configured to slide using a means for enabling slideable movement, and a pivot bar coupling the pivot plate and the runner plate in a hinge configuration, where the slider assembly is affixed to the moveable gangway structure using at least a means for swiveling;

aligning the runner plate on the gangway supporting structure such that the means for enabling slideable movement make contact with longitudinal edges of the gangway supporting structure, and where the slider assembly reduces torsional twisting of the shore access system;

affixing a motor to the gangway supporting structure such that the motor is configured to automate longitudinal movement of the runner plate along the gangway supporting structure; and affixing a sensor near a proximal end of the moveable gangway structure such that the sensor is configured to trigger activation of the motor in response to the sensor detecting water, where the sensor is a water detection sensor, and the affixing of the gangway supporting structure into the variable shoreline includes affixing support members to the gangway supporting structure before affixing into the variable shoreline.

12. The method of claim 11, where the runner plate is slideable along a longitude of the gangway supporting structure, where the longitudinal edges are opposing sides of the gangway supporting structure, and where the means for enabling slideable movement include cam followers.

13. The method of claim 11, further comprising:

after aligning the runner plate, installing a stopping mechanism on the gangway supporting structure to prevent the runner plate of the moveable gangway structure from sliding off the gangway supporting structure.

* * * * *